US006840835B1

(12) United States Patent
Tuck

(10) Patent No.: US 6,840,835 B1
(45) Date of Patent: Jan. 11, 2005

(54) FIELD EMITTERS AND DEVICES

(75) Inventor: Richard Allan Tuck, Slough (GB)

(73) Assignee: Printable Field Emitters Limited, Chilton (GB)

( * ) Notice: Subject to any disclaimer, the term of this patent is extended or adjusted under 35 U.S.C. 154(b) by 51 days.

(21) Appl. No.: 10/049,885

(22) PCT Filed: Aug. 21, 2000

(86) PCT No.: PCT/GB00/03242

§ 371 (c)(1),
(2), (4) Date: Jun. 4, 2002

(87) PCT Pub. No.: WO01/15194

PCT Pub. Date: Mar. 1, 2001

(30) Foreign Application Priority Data

Aug. 21, 1999 (GB) ..... 9919737

(51) Int. Cl.[7] ..... H01J 9/00; H01J 9/02

(52) U.S. Cl. ..... 445/50; 445/49; 445/51; 427/64; 427/66; 427/68; 427/466; 427/468

(58) Field of Search ..... 445/49, 50, 51; 427/64, 66, 68, 466, 468; 313/310, 311, 346 R

(56) References Cited

U.S. PATENT DOCUMENTS 6,113,448 A * 9/2000 Kobayashi et al. ..... 445/24
6,445,114 B1 * 9/2002 Kurokawa et al. ..... 313/310
6,524,154 B2 * 2/2003 Xia et al. ..... 445/52
6,626,724 B2 * 9/2003 Yamamoto et al. ..... 445/24

* cited by examiner

*Primary Examiner*—Kenneth J. Ramsey
*Assistant Examiner*—Mariceli Santiago
(74) *Attorney, Agent, or Firm*—Barnes & Thornburg

(57) ABSTRACT

A masking layer (405) is provided on selected areas of an electrode structure that is at least partly performed, to define masked areas and unmasked areas (emitter cells 410). A first constituent with particles (408) and a second constituent (409) are then applied to the emitter cells (410), and the particles (408) are selectively directed towards the bottoms of the emitter cells (410)—e.g. by electrophoresis. The masking layer (405) is then removed from the masked areas, together with any stray quantities of the first and second constituents (408, 409) on the masking layer (405). The first and second constituents (408, 409) are then processed (e.g. by curing) to create broad area field electron emission sites in desired locations of the electrode structure.

31 Claims, 8 Drawing Sheets

FIELD EMITTERS AND DEVICES

Figure 1A:
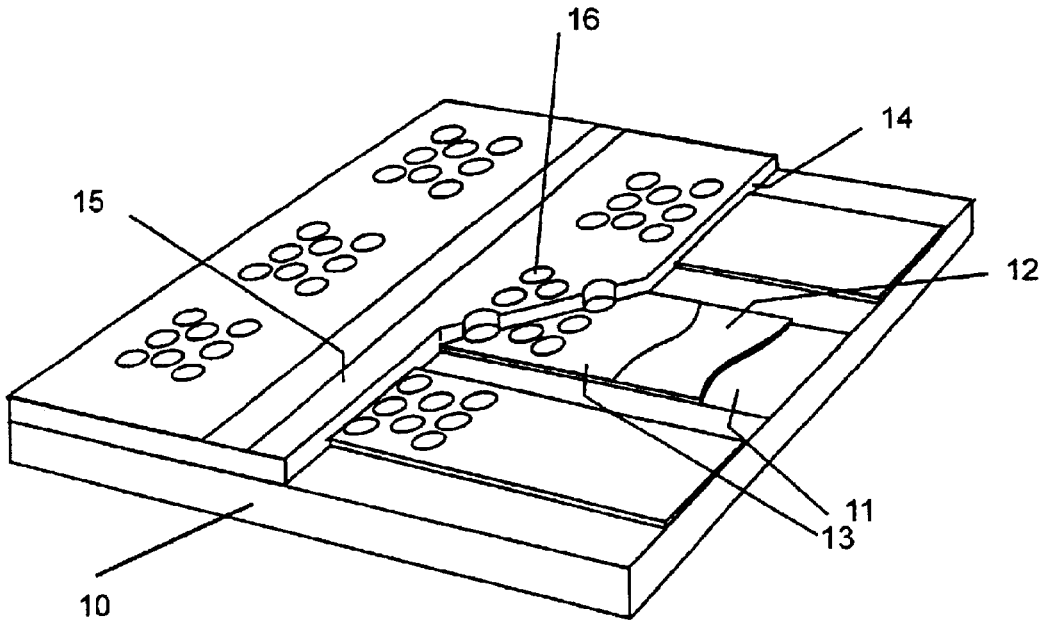

This invention relates to field emission materials and devices, and is concerned particularly but not exclusively with methods of manufacturing addressable field electron emission cathode arrays. Preferred embodiments of the present invention aim to provide low manufacturing cost methods of fabricating multi-electrode control and focusing structures.

It has become clear to those skilled in the art that the key to practical field emission devices, particularly displays, lies in arrangements that permit the control of the emitted current with low voltages. At the present time, the majority of the art in this field relates to tip-based emitters—that is, structures that utilise atomically sharp micro-tips as the field emitting source.

There is considerable prior art relating to tip-based emitters. The main objective of workers in the art has been to place an electrode with an aperture (the gate) less than 1 micron away from each single emitting tip, so that the required high fields can by achieved using applied potentials of 100V or less—these emitters are termed gated arrays. The first practical realisation of this was described by C A Spindt, working at Stanford Research Institute in California (*J.Appl.Phys.* 39.7. pp3504–3505, (1968)). Spindt's arrays used molybdenum emitting tips which were produced, using a self masking technique, by vacuum evaporation of metal into cylindrical depressions in a $SiO_2$ layer on a Si substrate. Many variants and improvements on the basic Spindt technology are described in the scientific and patent literature.

An alternative important approach is the creation of gated arrays using silicon micro-engineering. Field electron emission displays utilising this technology are being manufactured at the present time, with interest by many organisations world-wide. Again many variants have been described.

A major problem with all tip-based emitting systems is their vulnerability to damage by ion bombardment, ohmic heating at high currents and the catastrophic damage produced by electrical breakdown in the device. Making large area devices is both difficult and costly. Furthermore, in order to get low control voltages, the basic emitting clement, consisting of a tip and its associated gate aperture, must be approximately one micron or less in diameter. The creation of such structures requires semiconductor-type fabrication technology with its high associated cost structure. Moreover, when large areas are required, expensive and slow step and repeat equipment must be used.

In about 1985, it was discovered that thin films of diamond could be grown on heated substrates from a hydrogen-methane atmosphere, to provide broad area field emitters.

In 1988 S Bajic and R V Latham, (*Journal of Physics D Applied Physics*, vol. 21 200–204 (1988)), described a low-cost composite that created a high density of metal-insulator-metal-insulator-vacuum (MIMIV) emitting sites. The composite had conducting particles dispersed in an epoxy resin. The coating was applied to the surface by standard spin coating techniques.

Much later (1995) Tuck, Taylor and Latham (GB 2 304 989) improved the above MIMIV emitter by replacing the epoxy resin with an inorganic insulator that both improved stability and enabled it to be operated in sealed off vacuum devices.

The best examples of such broad-area emitters can produce usable electric currents at fields less than 10 $V\square m^{-1}$. In the context of this specification, a broad-area field emitter is any material that by virtue of its composition, micro-structure, work function or other property emits useable electronic currents at macroscopic electrical fields that might be reasonably generated at a planar or near-planar surface—that is, without the use of atomically sharp micro-tips as emitting sites.

Electron optical analysis shows that the feature size required to control a broad-area emitter is nearly an order of magnitude larger than for a tip-based system. Zhu et al (U.S. Pat. No. 5,283,501) describes such structures with diamond-based emitters. Moyer (U.S. Pat. No. 5,473,218) claims an electron optical improvement in which a conducting layer sits upon the broad-area emitter to both prevent emission into the gate insulator and focus electrons through the gate aperture. The concept of such structures was not new and is electronoptically equivalent to arrangements that had been used in thermionic devices for many decades. For example Winsor (U.S. Pat. No. 3,500,110) described a shadow grid at cathode potential to prevent unwanted electrons intercepting a grid set at a potential positive with respect to the cathode. Somewhat later Miram (U.S. Pat. No. 4,096,406) improved upon this to produce a bonded grid structure in which the shadow grid and control grid are separated by a solid insulator and placed in contact with the cathode. Moyer's arrangement simply replaced the thermionic cathode in Mirarm's structure with an equivalent broad-area field emitter. However, such structures are useful, with the major challenge being methods of constructing them at low cost and over large areas. It is in this area that preferred embodiments of the present invention make a contribution to the art.

Figure 1B:
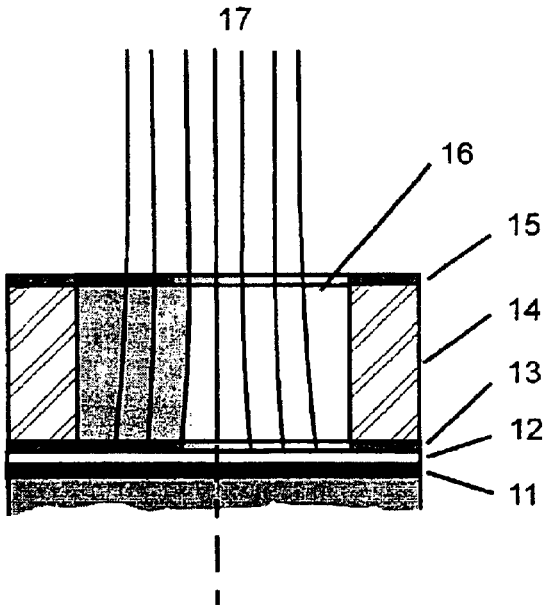

The applicants patent GB 2 330 687 B describes a low manufacturing cost method of manufacturing a field emission display (FED) cathode plane using a broad-area field emitter. FIGS. 1*a* and 1*b* of the accompanying diagrammatic drawings show the structure of the cathode plane produced by this method in which a substrate 10 (usually glass) is overlaid with cathode tracks 11, emitter layer 12, focus grid track 13, gate insulator 14 and gate tracks 15. All such tracks and layers are deposited by low resolution means e.g. printing. The upper surface is then coated with a resist layer which is exposed and developed to open apertures 16 in the resist to define the diameters of the emitter cells. A self aligning process using differential etches is then used to form the emitter cells and expose the emitter layer 12. Setting the gate electrode 15 positive with respect to the emitter layer 12 causes the emission of electrons 17 into the device.

Although this invention offers many advantages over the previous art it is best suited to emitter layers that have a surface roughness significantly less than the thickness of the gate insulator layer.

Figure 2A:
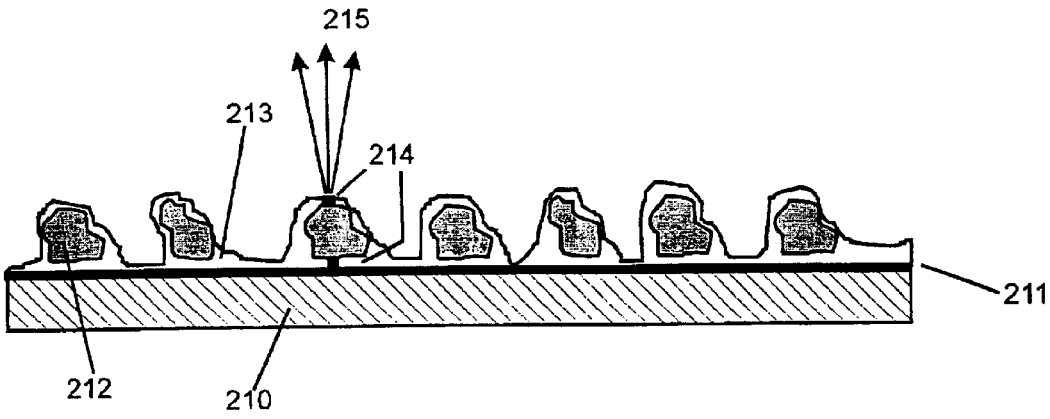

Many so-called broad-area emitters contain particles that either form the emitters themselves or are part of a composite emitter where one of their roles is to concentrate the macroscopic electric field. Examples of emitters of this type are described in the applicant's specifications GB 2 332 089 and GB 2 330 687. FIG. 2*a* of the accompanying diagrammatic drawings shows a typical structure of such an emitter as described in GB 2 332 089 in which a substrate 210 (usually glass) has a conducting layer 211 coated with conducting particles 212 disposed within an insulating medium 213. On application of an electric field, conducting channels 214 form which transport and a "heat" the electrons passing through them so that they are emitted at 215 into the vacuum. By a "channel" or "conducting channel" we mean a region of the insulator where its properties have been locally modified, usually by some forming process involving charge injection or heat. Such modification facilitates the injection of electrons from the conducting back contact into the insulator such that the electrons may move through it gaining energy and be emitted over or through the surface potential barrier into the vacuum. In a crystalline solid the injection may be directly into the conduction band or, in the case of amorphous materials, at an energy level where hopping conduction is possible. For optimum performance the thickness of the insulator layers above and below the particle should be thin compared to the dimensions of the particle. Given this requirement, the emitter surface tends to have a roughness of the same order as the particle dimensions. Typical particle dimensions are in the few micron range.

Figure 2B:
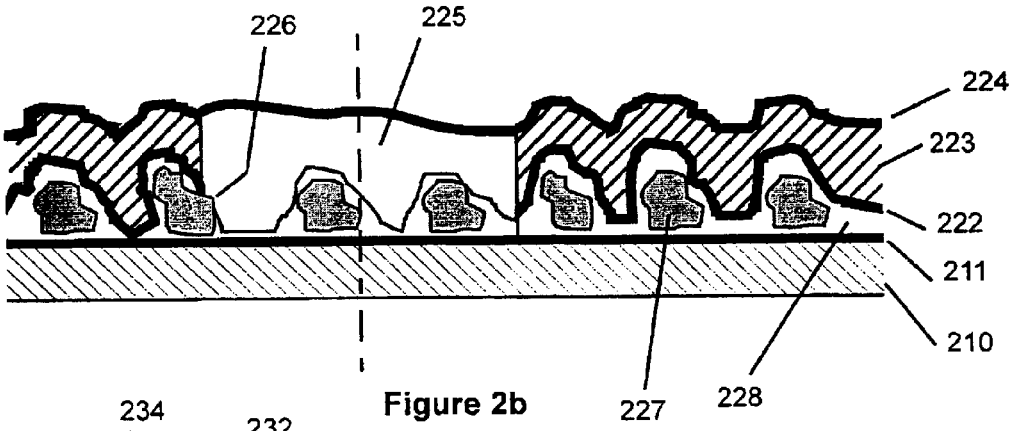

FIG. 2*b* of the accompanying diagrammatic drawings shows an exemplary case where an emitter with 2 micron particles is used in an 8 micron diameter emitter cell fabricated in a nominal 4 micron thick gate insulator. The layered structure is as follows: substrate 210 (usually glass), conducting cathode track 211, conducting particles 227 in insulator medium 228, focus grid track 222, gate insulator layer 223 and gate track 224. The emitter cell opening 225 just exposes a potential emitter 226. From a device operational perspective this example is satisfactory for use in say a FED, since the high electric field between the gate and the anode of the display will tend to straighten the electron trajectories.

Figure 2C:
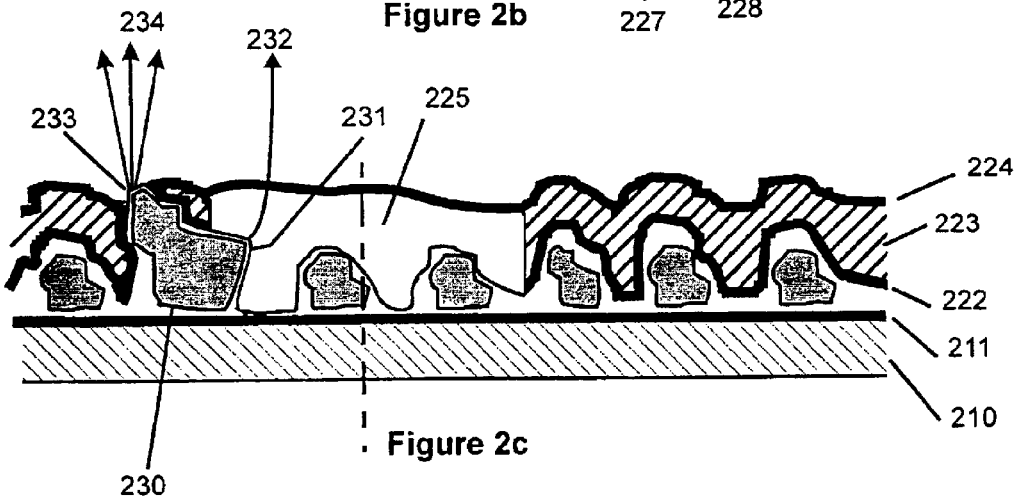

FIG. 2*c* of the accompanying diagrammatic drawings shows a far less satisfactory occurrence in which a large particle and its associated insulator coating 230 disrupt the gate structure to form two potential emitting sites. Emitting site 231 is benign since electrons 232 will only be emitted when the gate electrode 224 is in the "on" condition. Potential emitting site 233 presents a major problem since it could, under the influence of the DC field between the gate and anode, emit a continuous and uncontrolled current. In a display device this would result in a permanent bright spot and a scrapped panel.

It has occurred to us that it would be very desirable for such devices if the electrode and gate structures, which are made from materials that yield smooth films, could be fabricated first and the particle-containing emitter layer added as a final operation.

Figure 3A:
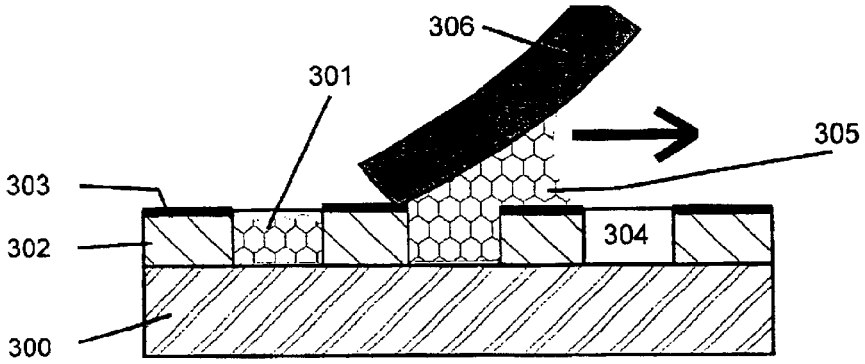
Figure 3B:
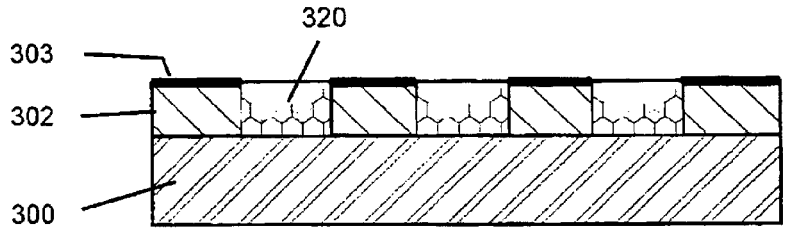
Figure 3C:
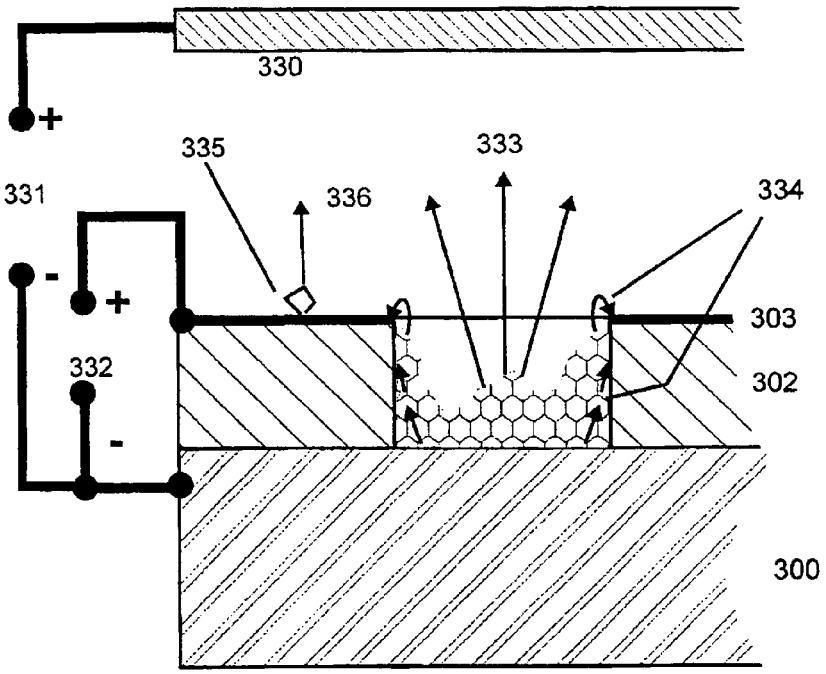

Moving now to FIG. 3*a* of the accompanying diagrammatic drawings, Geis et al (*J. Vac. Sci. Technol.* 8 14(3) May/June 1996) describe a technique that involves forming a gated structure with a gate electrode 303 deposited on a silicon dioxide layer 302 that is grown on a conducting silicon substrate 300. Emitter cells 301 are formed by standard semiconductor fabrication processes. A paste 305 containing diamond particles is forced into the empty emitter cells 304 using a squeegee 306. The filled assembly is fired to 1080° C. in a reducing atmosphere to evaporate the binder and form a compact 320, as shown in FIG. 3*b* of the accompanying diagrammatic drawings, with good electrical and mechanical contact between the diamond and the silicon. Nickel may be added to the paste to facilitate electrical contact. The final assembly is plasma treated and then caesiated to reduce the electron affinity. Geis states that although this structure emits well, there is a very large gate current. FIG. 3*c* of the accompanying diagrammatic drawings shows that this is likely to be caused by both current flow through the compact and emission direct to the gate 334 when voltages 332 and 331 are applied to the gate 303 and anode 330 respectively. Such spurious currents can be large compared to the desired emitted current 333. It is our view that this outcome is inevitable with this approach since the diamond particles tend to cling to the sidewalls of the emitter cells. Another problem is emitting debris 335 being left on top of the gate where it will produce uncontrolled currents 336. Passing mention is made of the use of spray or electrophoretic deposition but no details are given.

Danroc (U.S. Pat. No. 5,836,796) describes the use of electrophoresis to coat microtip emitters with fine diamond particle emitters to enhance emission. A metal additive deposited by electroplating is used to provide good electrical contact between the diamond and the metal microtip. Danroc is concerned only with microtip emitters.

Jin (U.S. Pat. No. 5,811,916) is concerned with field emission displays using a very specific type of diamond material. Jin mentions in passing the use of electrophoresis to dispose particles of this material, which is an emitting material per se, on a substrate, but no details are given.

EP-A-0932180 describes techniques for fixing conductive particles to a substrate in a defined pattern to form a field emitter. The particles are deposited in a uniform manner, and patterned by removal in unwanted areas. The particles are disclosed as being an emitting material per se.

FR-A-2723255 adapts standard tip-emitter techniques (namely use of an aluminium separation layer) to thin-film diamond. The specification describes the deposition of thin-film diamond onto a structure, and its subsequent removal of material by dissolving the separation layer 22. The diamond is deposited in a uniform manner, and patterned by removal in unwanted areas. The diamond is assumed to be an emitting material per se.

Preferred embodiments of the present invention aim to provide improved field emitting structures wherein a particulate-containing composite field electron emitter is made in situ within a previously fabricated electrode structure. Said process preferably includes the use of electrophoresis to optimally locate the particles within the electrode structure. The emitter structures may be used in devices that include: field electron emission display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles; particle accelerators; lamps; ozonisers; and plasma reactors.

According to one aspect of the present invention, there is provided a method of creating a composite broad area field electron emitter within an electrode structure that is at least partly preformed, the method comprising the steps of:

a) providing a masking layer on selected areas of said electrode structure, to define masked areas and unmasked areas of said electrode structure;

b) after step a), applying at least a first particulate constituent and a second constituent to said unmasked areas of said electrode structure, such that particles of said first constituent are selectively directed towards desired locations within said unmasked areas, thereby avoiding other locations of said unmasked areas; and after step b):

c) removing said masking layer from said selected areas, together with any stray quantities of said constituents on said masking layer; and d) processing said constituents to create a broad area field electron emission material having emission sites in said desired locations of said electrode structure.

Preferably, step d) is carried out after step c).

Said particles may be applied in step b) as a plurality of electrically conductive particles in a solution or colloidal dispersion of an electrically insulating material or a chemical precursor therefore, with the process of step d) resulting in said electrically conductive particles being coated in said electrically insulating material.

The process of step d) may include removing fugitive components of said solution or dispersion.

A liquid component of said solution or dispersion may have dissolved in it a chemical precursor for said electrically insulating material, and the method may comprises decomposing said precursor by heat, ultra-violet light or other means to form said electrically insulating material.

Said precursor may be in the form of a sol-gel.

Said precursor may comprise a soluble polymer.

Said particles may comprise electrically conductive particles pre-coated with an electrically insulating material.

Said electrically insulating material may comprise silica.

Step (b) may comprise spray applying said first and second constituents onto said selected areas of said electrode structure, through apertures which are provided on said electrode structure and which direct said particles of said first constituent selectively towards said desired locations.

Said apertures may be defined by parts of said electrode structure which overlie recesses formed in said electrode structure, such that said first and second constituents are directed selectively towards the bottoms of said recesses rather than side walls thereof.

Said recesses may have side walls which slope inwardly towards the bottoms of the recesses.

Preferably, each said recess is formed by a wet-etch process which forms an undercut below the respective part of said electrode structure which overlies the respective recess.

Said electrically insulating material may be in the form of a dispersion of colloidal or fine particles which subsequently are sintered together by the action of heat to form a solid phase.

A method as above may include the step of applying to said particles a metal and subsequently oxidising that metal to form an electrically insulating material.

Said metal may be applied also to a cathode track.

Said metal may be applied by electroplating.

Preferably, said particles are electrically conductive particles, which may comprise graphite.

The process of step d) may result in said conductive particles each with a layer of electrically insulating material disposed in a first location between said conductive surface and said particle, and/or in a second location between said particle and the environment in which the electrode structure is disposed, such that at least some of said particles form electron emission sites at said first and/or second locations.

A method as above may include the step of adding to said conductive particles and/or layers of electrically insulating material further layers to promote electron emission.

A method as above may include the further step of curing or part-curing between steps b) and c).

Said processing step d) may include curing.

Preferably, said electrode structure has preformed emitter cells and said desired locations are within said emitter cells.

Preferably, each of said desired locations comprises the bottom of a hole.

Preferably, each of said desired locations is at an electrically conductive surface.

Said particles may be applied in a carrier in step b) and the method may include the step of subsequently removing excess of said carrier from said electrode structure.

Said excess of said carrier may be removed by a squeegee or similar means.

Preferably, said selective application of said particles is effected by electrophoresis.

Preferably, said masking layer is provided in step (a) as part of a process to form at least part of said electrode structure, prior to carrying out step (b).

Preferably, said second constituent is a precursor for an electrical insulator which is formed in step (d).

The invention extends to a field electron emitter created by a method according to any of the preceding aspects of the invention.

In another aspect, the invention provides a field electron emission device comprising such a field electron emitter, and means for subjecting said emitter to an electric field in order to cause said emitter to emit electrons.

Such a device may comprise a substrate with an array of emitter patches of said field electron emitters, and control electrodes with aligned arrays of apertures, which electrodes are supported above the emitter patches by insulating layers.

Preferably, said apertures are in the form of slots.

A device as above may comprise a plasma reactor, corona discharge device, silent discharge device, ozoniser, an electron source, electron gun, electron device, x-ray tube, vacuum gauge, gas filled device or ion thruster.

The field electron emitter may supply the total current for operation of the device.

The field electron emitter may supply a starting, triggering or priming current for the device.

A device as above may comprise a display device.

A device as above may comprise a lamp.

Said lamp may be substantially flat.

Said emitter may be connected to an electric driving means via a ballast resistor to limit current.

Said ballast resistor may be applied as a resistive pad under each said emitting patch.

Said emitter material and/or a phosphor may be coated upon one or more one-dimensional array of conductive tracks which are arranged to be addressed by electronic driving means so as to produce a scanning illuminated line.

Such a device may include said electronic driving means.

Said field emitter may be disposed in an environment which is gaseous, liquid, solid, or a vacuum.

A device as above may comprise a cathode which is optically translucent and is so arranged in relation to an anode that electrons emitted from the cathode impinge upon the anode to cause electro-luminescence at the anode, which electro-luminescence is visible through the optically translucent cathode.

It will be appreciated that the electrical terms "conducting" and "insulating" can be relative, depending upon the basis of their measurement. Semiconductors have useful conducting properties and, indeed, may be used in the present invention as conductors. In the context of this specification, an insulating material has an electrical resistivity at least $10^2$ times (and preferably at least $10^3$ or $10^4$ times) that of a conducting material.

Figure 5A:
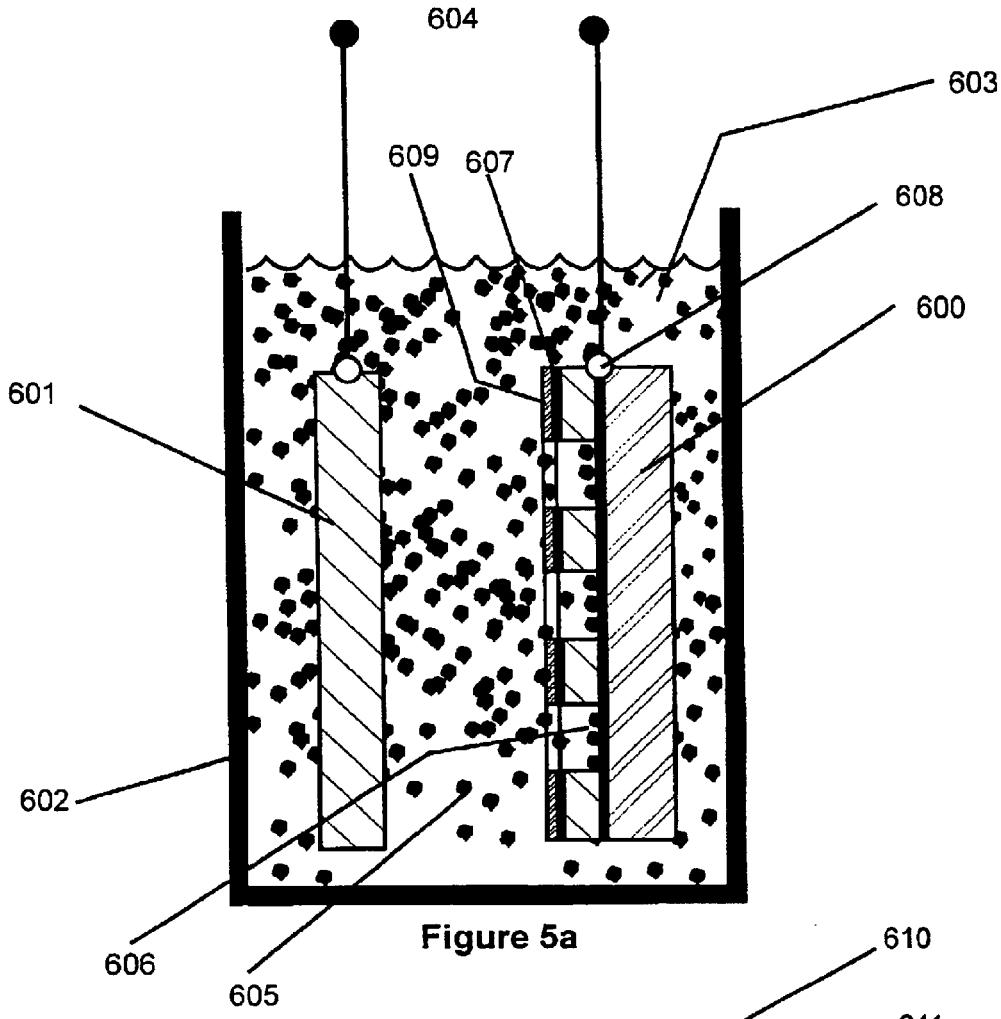
Figure 5B:
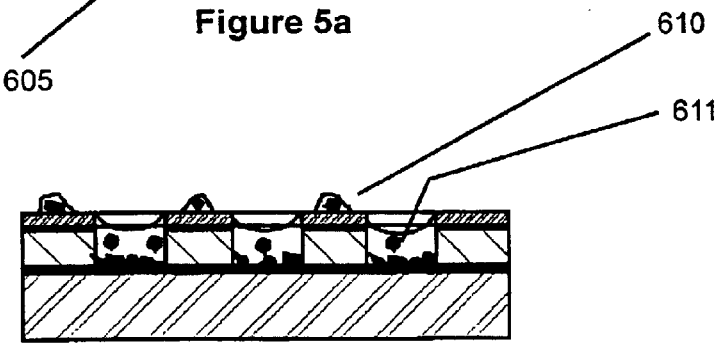
Figure 5C:
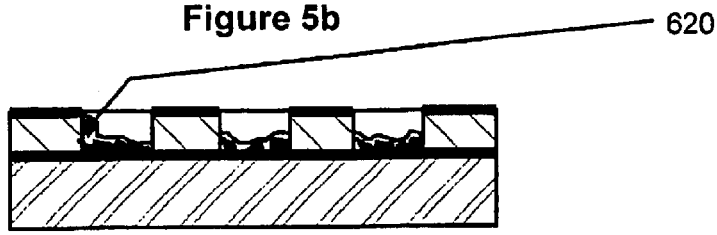
Figure 6A:
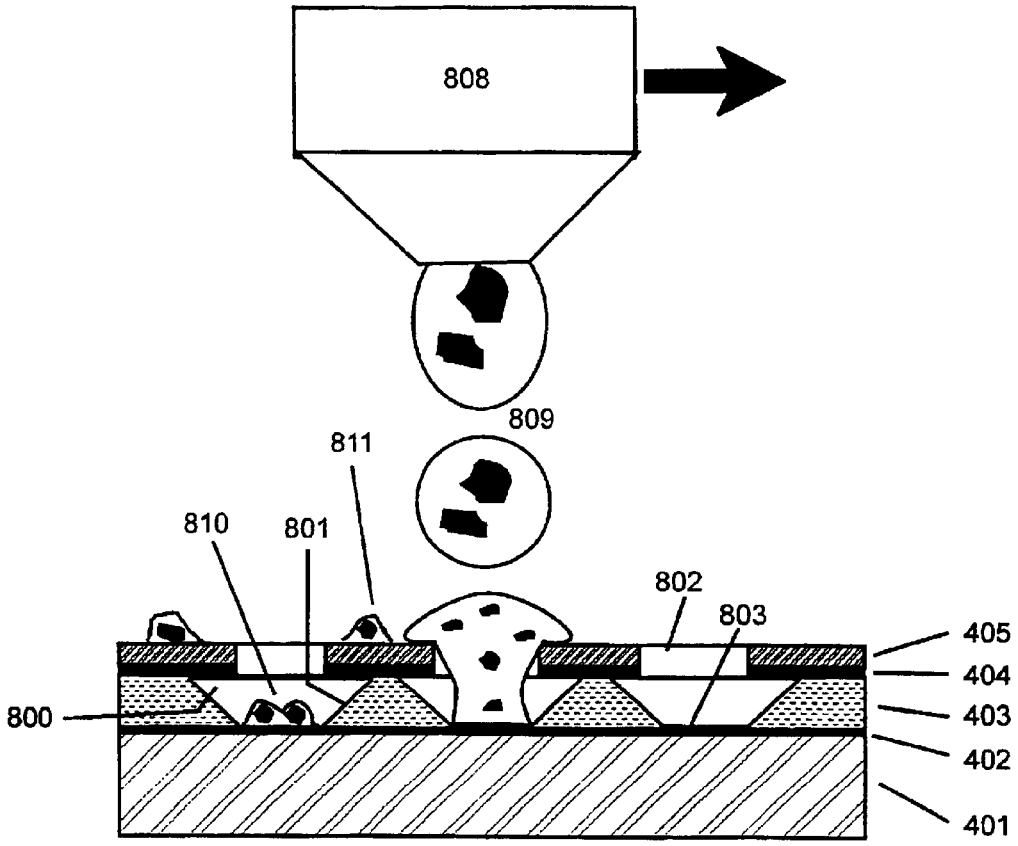
Figure 6B:
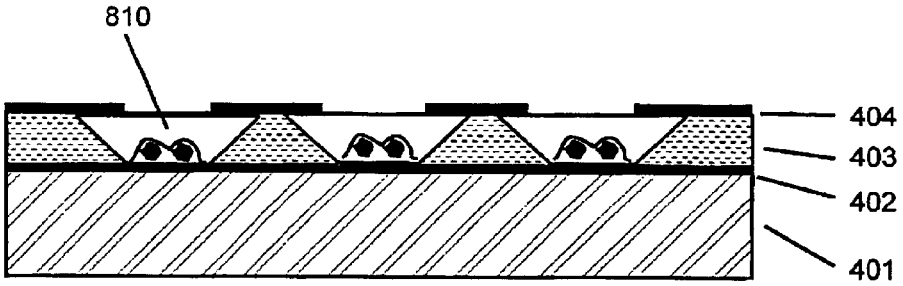
Figure 6C:
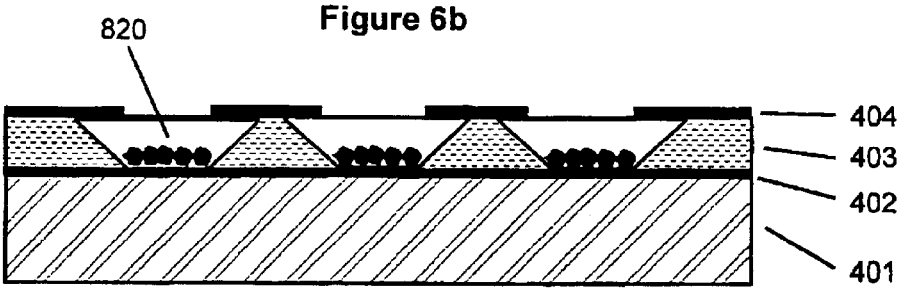
Figure 7A:
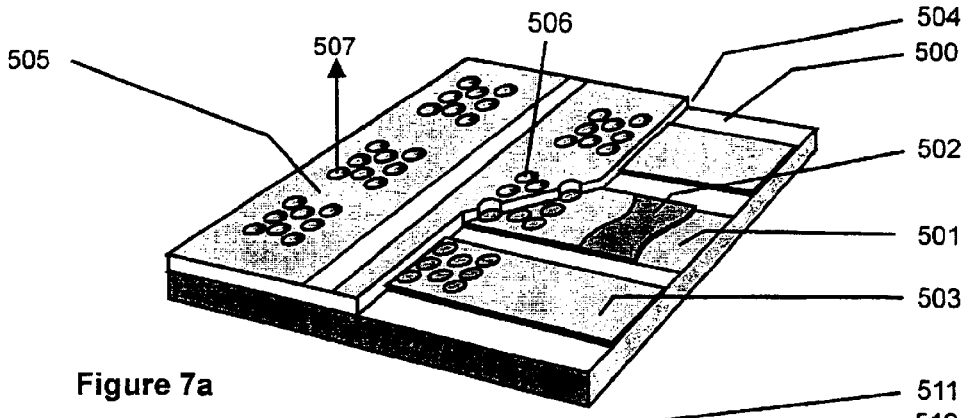
Figure 7B:
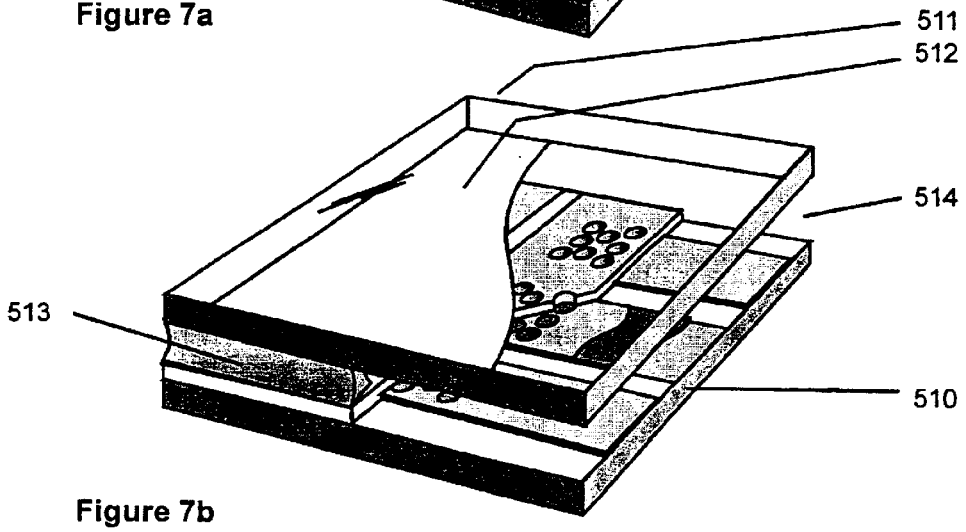
Figure 7C:
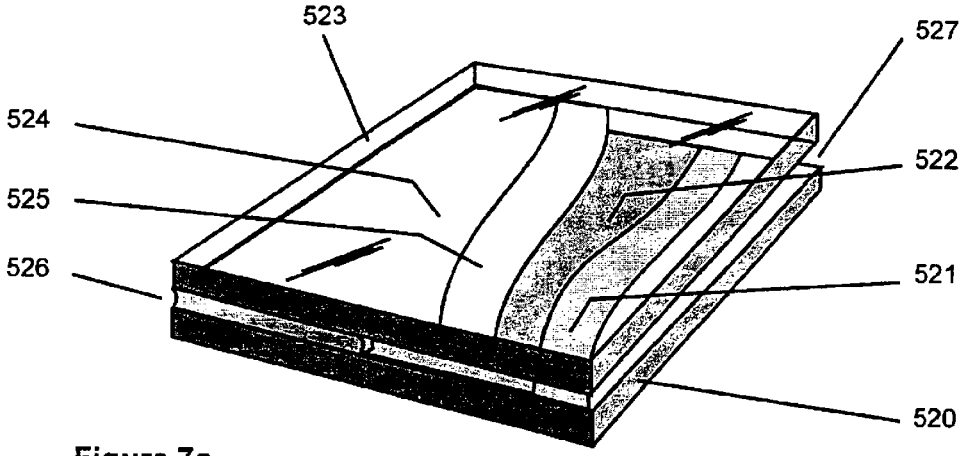

For a better understanding of the invention, and to show how embodiments of the same may be carried into effect, reference will now be made, by way of example, to the accompanying diagrammatic drawings, and in which:

FIGS. 1*a* and 1*b* show the structure of a cathode plane;

FIG. 2*a* shows a typical structure of an emitter;

FIG. 2*b* shows an exemplary case where an emitter with 2 micron particles is used in an 8 micron diameter emitter cell fabricated in a nominal 4 micron thick gate insulator;

FIGS. 3*a*, 3*b* and 3C illustrate a technique that involves forming a gated structure with a gate electrode deposited on a silicon dioxide layer that is grown on a conductive silicon substrate;

FIGS. 4*a* to 4*e* illustrate steps in one example of a method of creating a broad area field electron emitter;

FIGS. 5*a* to 5*c* illustrate steps in another example of a method of creating a broad area field electron emitter;

FIGS. 6*a* to 6*c* illustrate steps in yet another example of a method of creating a broad area field electron emitter, and FIGS. 7*a* to 7*c* illustrate examples of devices that utilise examples of broad area field electron emitters.

Embodiments of this invention may have many applications and some of these will be described by way of the following examples. It should be understood that the following descriptions are only illustrative of certain embodiments of the invention. Various alternatives and modifications can despised by those skilled in the art.

EXAMPLE 1

We describe, by way of example, an emitter structure utilising a MIMIV emitter system as described in our GB 2 304 989 B. In this example, an emitter composite layer is assembled within an emitter cell in, say, a display, from its components. Emitters as described in our GB 2 304 989 B are routinely deposited on plane surfaces by spin coating using inks. These inks comprise an insulator precursor, such as a polymer or sol-gel; a solvent for the precursor; dispersants and surfactants plus the conducting particles. Following spin coating, the layer is heat treated to form the final layer. One such ink consists of a silica sol-gel dissolved in propan-2-ol with graphite particles dispersed to form a suspension. After spin coating a heat treatment profile to 450° C. in air is used to cure the layer. The reader is directed to our co-pending application PCT/GB00/02537, a copy of the specification and drawing of which accompany the present application.

A suitable formulation for the ink is:

1) Sol-gel preparation

Tetraethyl orthosilicate (10 ml), and MOS grade propan-2-ol (47 ml) are mixed and cooled to 5–10° C. with stirring at 1000 r.p.m. To this stirring mixture is then added a solution of concentrated nitric acid (0.10 g) in deionised water (2.5 g). After 2 hours, the mixture is transferred to a sealed container, and stored at 4° C. in a refrigerator until required.

The proportion of MOS grade propan-2-ol is adjusted on test so that the number of particles and their ratio to insulator solid will be correct in the emitter cell that is used.

2) Dispersion Preparation

Nominal 6 micron graphite particles (0.150 g) and a sol-gel dispersion according to (1) above (9.850 g) previously filtered through a 0.2 micron filter are mixed, and ultrasonically agitated for 10 minutes using a high power ultrasonic probe. The sample is allowed to cool to room temperature and ultrasonically agitated for a further 10 minutes. This yields the required ink as a black suspension. The mixture is transferred to a sealed container and stored in a refrigerator at 4° C.

Figure 4A:
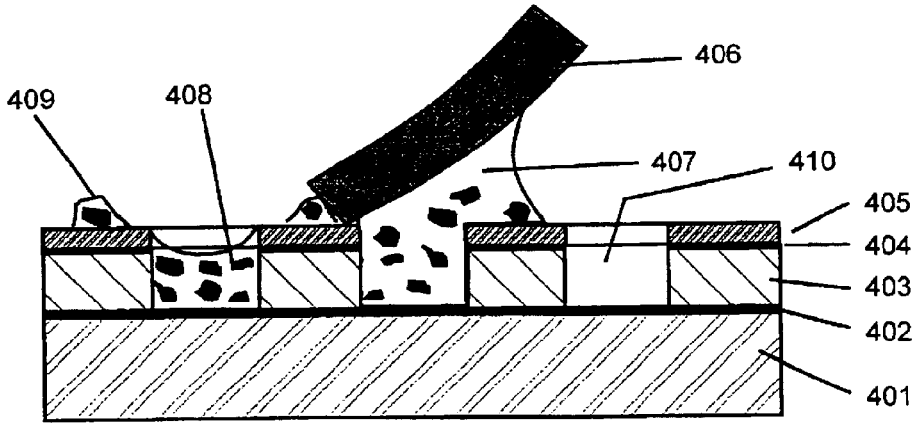

FIG. 4*a* shows a substrate (usually glass 401); a cathode conducting track 402 (typically gold); an insulating layer 403 (usually glass); and a gate conductor 404 (typically gold). A photoresist layer 405 remains following the use of a self aligning process to form emitter cells 410. Such a structure may be fabricated by using the process that is described conceptually with reference to FIGS. 1*a* and 1*b* but missing out the emitter layer 12 and the focus grid layer 13. Full details of this process is described in our patent GB 2 330 687 B, to which the reader's attention is directed. It will be clear to those skilled in the art how the processes therein may be adapted to fabricate the structure described in FIG. 4*a*. However, the present invention is not limited to structures fabricated using this process. Other approaches, such as standard semiconductor fabrication processes, may be used.

Again referring to FIG. 4*a*, an ink 407 comprising both particles 408 and a solution of insulator precursor is then applied to fill the empty emitter cells using a squeegee 406. During the squeegee process some unwanted particles with associated insulator precursor 409 will inevitably be deposited on the photoresist layer 405 covering the gate electrode.

At this point in the process we have a metered volume of ink in each emitter cell. The ink is formulated such that said volume of ink contains sufficient particles to lightly cover the base of the cell and sufficient insulator precursor to form an insulator layer of the required thickness once curing has taken place. If the curing process were performed now there would be, because of surface tension, a high probability that many particles will either form piles at the base of the cell or be fixed to its wall.

Figure 4B:
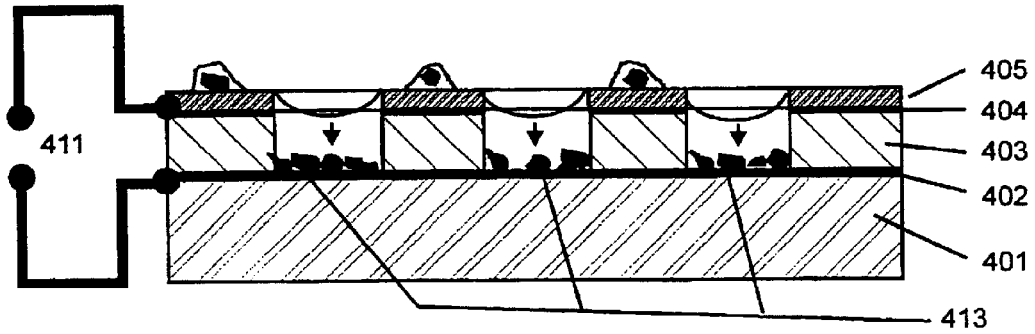

FIG. 4*b* shows how this may problem may be avoided. Either following the squeegee process or before it is started, an electrical potential 411 is applied between the cathode track 402 and the gate electrode 404. The particles in suspension 413 will then be swept out of suspension and electrophoretically coated directly onto the cathode track 402. With insulating solvents this requires the cathode track to be biased positively with respect to the gate tracks Electric fields in the range tens to hundreds of volts/cm are required. Any insulator precursor that adheres to the walls of the cell and is subsequently cured will be free of particles and thus not form emitting sites.

Alternative methods to a squeegee may be used to apple the suspension, such as K-coaters (wire roll) as supplied by R K Print-Coat Instruments Ltd, Litlington, Royston, Hertforshire, UK. Equally purpose-designed dispensers based, for example, on the extrusion of the suspension through slots may be utilised.

Following the electrophoretic deposition step the substrates are transferred to hotplates under the following conditions: a) 10 minutes at 50° C.—measured surface temperature of hotplate; b) 10 minutes at 120° C.—measured surface temperature of hotplate.

Figure 4C:
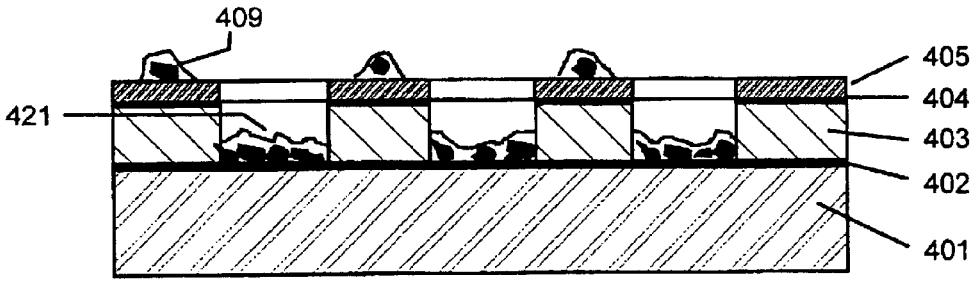

We are now at the stage shown in FIG. 4*c* with a partially cured emitter layer 421 at the bottom of the cells and unwanted potential emitters 409 on the surface of the gate 405.

Figure 4D:
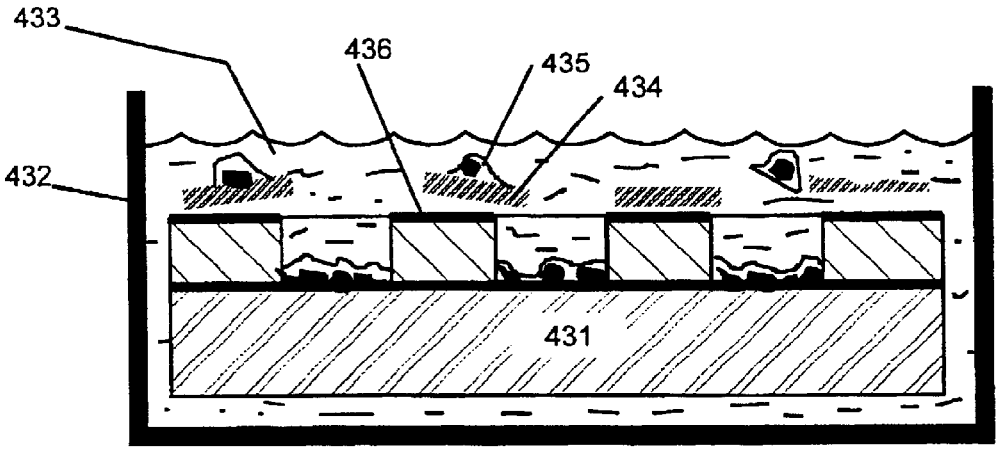

Moving now to FIG. 4*d* the assembly 431 is transferred to an ultrasonic cleaner 432 filled with MOS grade acetone 433. The cleaner is operated for 10–20 seconds whilst agitating the assembly. During this period the photoresist layer 434 is removed together with unwanted debris 435 by a lift-off process, to provide a substantially planar outer surface 436 of the gate conductor 404.

The assembly is then rinsed on both sides with MOS grade acetone and again with MOS grade propan-2-ol.

Following the electrophoretic deposition step the substrates are transferred to hotplates under the following conditions: a) 10 minutes at 50° C.—measured surface temperature of hotplate; b) 10 minutes at 120° C.—measured surface temperature of hotplate.

The substrates are then transferred to an oven (air atmosphere) according to the following profile: ambient to 450° C. at 10° C./min; isotherm at 450° C. for 120 minutes; followed by cooling naturally to room temperature.

Figure 4E:
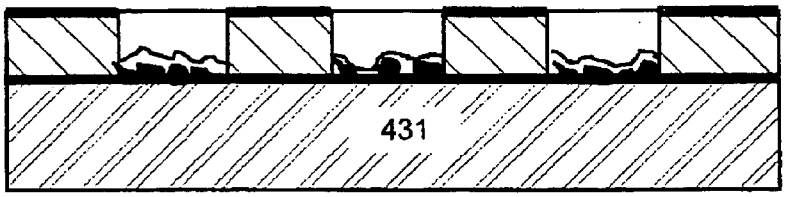

The resulting emitter structure is shown in FIG. 4*e*

EXAMPLE 2

Moving now to FIG. 5 a more conventional approach to electrophoresis is used. A bath 602 contains a suspension of particles 605 in an insulator precursor solution 603. A formulation similar to that in Example 1 may be used but with the concentration of particles much reduced. The substrate to be coated 600 (together with tracks, layers and emitter cells generally as described above with reference to FIG. 4) is suspended in the bath and electrical connection 608 from one terminal of a power supply 604 is made to the cathode track. The gate electrode 607 is allowed to float electrically and is preferably covered with a layer of photoresist 609. A counter electrode 601 is connected to another terminal of power supply 604. On application of a voltage with a typical electric field in the range tens to hundreds of volts/cm the particles 605 are selectively electrophoretically coated onto the base of the emitter cells 606.

The substrate is now removed from the bath and drained, so that it is as shown in FIG. 5*b*. Although this method can produce acceptable results, it can be seen that particles from the suspension 611 may remain in the volume of the emitter cell and, as shown in FIG. 5*c*, remain in undesirable locations 620 after curing. Potentially emitting debris 610 on the surface of the gate would remain, if the photoresist 609 were not used or not subsequently removed.

EXAMPLE 3

Moving now to FIGS. 6*a* to 6*c*, an alternative method of directing emitter material to desired locations is described. This approach takes advantage of the undercut that occurs naturally when a wet etching process is used.

FIG. 6*a*, wherein labels 401 to 405 have the same meaning as in previous examples, shows a cross-section though a part-processed gated field-emitting structure. Emitter cells 800 have sloping sides 801 which are typically formed by a wet etching process. The gate electrode 404 has apertures 802 aligned with cathode tracks 402, and overhangs the sloping sides 801 which have been undercut by the wet etching process. The objective is to deposit emitter material 810 onto the cathode track 803 whilst avoiding coating the gate insulator 801 exposed at the sides of the emitter cell. If the emitter material is sprayed onto the upper surface of the gate, preferably by means of a collimated spray 809, such as may be obtained from an inkjet print head 808, the overhanging gate electrode 404 will act as a mask, keeping the sloping sides 801 of the gate insulator clean. As the print head 808 traverses the structure, unwanted material 811 sprayed onto the surface of the gate 404 falls upon resist layer 405, with which it may subsequently be removed by a lift-off process, such as previously described, to leave a finished structure as shown in FIG. 6*b*.

The approach described in this example may be used for composite emitters as previously described in Example I, by co-depositing conductive particles and an insulator formed from a liquid phase precursor to form emitter material 810, as shown in FIG. 6*b*. Alternatively, as shown in FIG. 6*c*, fully fabricated particle-based emitters (e.g. conducting particles already coated by a thin layer of insulator as described in GB 2 304 989) may be selectively deposited, either suspended in a liquid medium or from a spray of dry particles. Once in place, the particles 820 may be affixed by means such as brazing or fritting.

The teaching herein concerning the assembly of a composite emitter in situ may be adapted to a wide range of situations. For example, as well as sol-gel and soluble insulator precursors (e.g. polymers), colloidal and fine particle suspensions may be used.

The insulator component may be formed by applying to the cathode track and particles (e.g. by electroplating) a metal that is subsequently oxidised.

The particles may also be electrophoretically deposited using an inert liquid medium and the insulator deposited in prior and/or subsequent process steps. Additional process steps may be introduced to add electron emission enhancing interface and surface layers as described in our co-pending application GB 2 340 299.

Thus, in the above-described embodiments of the invention, selected areas of an electrode structure are defined by a masking layer, and a first particulate constituent and a second constituent are then applied to those selected areas. By selectively directing the particles to desired locations within those selected areas, there is derived the advantage that the particles end up where emissions sites are wanted, and not where emissions sites are undesirable. A further useful manufacturing advantage can be obtained by making use of the masking layer, which has already served a purpose in part-forming the electrode structure, before being used again in applying the first and second constituents to selected areas.

The field electron emission current available from improved emitter materials such as are disclosed above may be used in a wide range of devices including (amongst others): field electron emission display panels; lamps; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles and particle accelerators.

Examples of some of these devices are illustrated in FIGS. 7*a*, 7*b* and 7*c*.

FIG. 7*a* shows an addressable gated cathode as might be used in a field emission display. The structure is formed of an insulating substrate 500, cathode tracks 501, emitter layer 502, focus grid layer 503 electrically connected to the cathode tracks, gate insulator 504, and gate tracks 505. The gate tracks and gate insulators are perforated with emitter cells 506. A negative bias on a selected cathode track and an associated positive bias on a gate track causes electrons 507 to be emitted towards an anode (not shown).

The reader is directed to our patent GB 2 330 687 B for further details of constructing Field Effect Devices.

The electrode tracks in each layer may be merged to form a controllable but non-addressable electron source that would find application in numerous devices.

FIG. 7*b* shows how the addressable structure 510 described above may joined with a glass fritt seal to a transparent anode plate 511 having upon it a phosphor screen 512. The space 514 between the plates is evacuated, to form a display.

Although a monochrome display has been described, for ease of illustration and explanation, it will be readily understood by those skilled in the art that a corresponding arrangement with a three-part pixel may be used to produce a colour display.

FIG. 7*c* shows a flat lamp using one of the above-described materials. Such a lamp may be used to provide backlighting for liquid crystal displays, although this does not preclude other uses, such as room lighting.

The lamp comprises a cathode plate 520 upon which is deposited a conducting layer 521 and an emitting layer 522. Ballast layers as mentioned above (and as described in our other patent applications mentioned herein) may be used to improve the uniformity of emission. A transparent anode plate 523 has upon it a conducting layer 524 and a phosphor layer 525. A ring of glass fritt 526 seals and spaces the two plates. The interspace 527 is evacuated.

The operation and construction of such devices, which are only examples of many applications of embodiments of this invention, will readily be apparent to those skilled in the art. An important feature of preferred embodiments of the invention is the ability to print an electrode pattern before assembly of the emitter layer in situ, thus enabling complex multi-emitter patterns, such as those required for displays, to be created at modest cost. Furthermore, the ability to print enables low-cost substrate materials, such as glass to be used; whereas micro-engineered structures are typically built on high-cost single crystal substrates. In the context of this specification, printing means a process that places or forms an emitting material in a defined pattern. Examples of suitable processes are (amongst others): screen printing, Xerography, photolithography, electrostatic deposition, spraying, ink jet printing and offset lithography.

Devices that embody the invention may be made in all sizes, large and small. This applies especially to displays, which may range from a single pixel device to a multi-pixel device, from miniature to macro-size displays.

Fugitive vehicles for the constituents of the emitter may be used in many examples.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all papers and documents which are filed concurrently with or previous to this specification in connection with this application and which are open to public inspection with this specification, and the contents of all such papers and documents are incorporated herein be reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of creating a composite broad area field electron emitter within an electrode structure that is at least partly preformed, the method comprising the steps of:

a) providing a masking layer on selected areas of said electrode structure, to define masked areas and unmasked areas of said electrode structure;

b) after step a), applying at least a first particulate constituent and a second constituent to said unmasked areas of said electrode structure, such that particles of said first constituent are selectively directed towards desired locations within said unmasked areas, thereby avoiding other locations of said unmasked areas; and after step b):

c) removing said masking layer from said selected areas, together with any stray quantities of said constituents on said masking layer; and d) processing said constituents to create a broad area field electron emission material having emission sites in said desired locations of said electrode structure.

2. A method according to claim 1, wherein step d) is carried out after step c).

3. A method according to claim 1, wherein said particles are applied in step b) as a plurality of electrically conductive particles in a solution or colloidal dispersion of an electrically insulating material or a chemical precursor therefor and the process of step d) results in said electrically conductive particles being coated in said electrically insulating material.

4. A method according to claim 3, wherein the process of step d) includes removing fugitive components of said solution or dispersion.

5. A method according to claim 3, wherein a liquid component of said solution or dispersion has dissolved in it a chemical precursor for said electrically insulating material, and the method comprises decomposing said precursor by heat, ultra-violet light or other means to form said electrically insulating material.

6. A method according to claim 5, where said precursor is in the form of a sol-gel.

7. A method according to claim 5, where said precursor comprises a soluble polymer.

8. A method according to claim 1, wherein said particles comprise electrically conductive particles pre-coated with an electrically insulating material.

9. A method according to claim 3, wherein said electrically insulating material comprises silica.

10. A method according to claim 1, wherein step (b) comprises spray applying said first and second constituents onto said selected areas of said electrode structure, through apertures which are provided on said electrode structure and which direct said particles of said first constituent selectively towards said desired locations.

11. A method according to claim 10, wherein said apertures are defined by parts of said electrode structure which overlie recesses formed in said electrode structure, such that said first and second constituents are directed selectively towards the bottoms of said recesses rather than side walls thereof.

12. A method according to claim 11, wherein said recesses have side walls which slope inwardly towards the bottoms of the recesses.

13. A method according to claim 12, including the step of forming each said recess by a wet-etch process which forms an undercut below the respective part of said electrode structure which overlies the respective recess.

14. A method according to claim 3, where said electrically insulating material is in the form of a dispersion of colloidal or fine particles which subsequently are sintered together by the action of heat to form a solid phase.

15. A method according to claim 1, including the step of applying to said particles a metal and subsequently oxidising that metal to form an electrically insulating material.

16. A method according to claim 15, wherein said metal is applied also to a cathode track.

17. A method according to claim 15, wherein said metal is applied by electroplating.

18. A method according to claim 1, wherein said particles are electrically conductive particles.

19. A method according to claim 18, wherein said electrically conductive particles comprise graphite.

20. A method according to claim 18, wherein the process of step d) results in said conductive particles each with a layer of electrically insulating material disposed in a first location between said conductive surface and said particle, and/or in a second location between said particle and the environment in which the electrode structure is disposed, such that at least some of said particles form electron emission sites at said first and/or second locations.

21. A method according to claim 20, including the step of adding to said conductive particles and/or layers of electrically insulating material further layers to promote electron emission.

22. A method according to claim 1, including a further step of curing or part-curing between steps b) and c).

23. A method according to claim 1, wherein said processing step d) includes curing.

24. A method according to claim 1, wherein said electrode structure has preformed emitter cells and said desired locations are within said emitter cells.

25. A method according to claim 1, wherein each of said desired locations comprises the bottom of a hole.

26. A method according to claim 1, wherein each of said desired locations is at an electrically conductive surface.

27. A method according to claim 1, wherein said particles are applied in a carrier in step b) and the method includes the step of subsequently removing excess of said carrier from said electrode structure.

28. A method according to claim 27, wherein said excess of said carrier is removed by a squeegee or similar means.

29. A method according to claim 1, wherein said selective direction of said particles is effected by electrophoresis.

30. A method according to claim 1, wherein said masking layer is provided in step (a) as part of a process to form at least part of said electrode structure, prior to carrying out step (b).

31. A method according to claim 1, wherein said second constituent is a precursor for an electrical insulator, which is formed in step (d).

* * * * *